US005516329A

United States Patent [19]

Dunn

[11] Patent Number: 5,516,329

[45] Date of Patent: May 14, 1996

[54] HOOD AND DUCT SYSTEM FOR TEXTILE EQUIPMENT

[76] Inventor: Preston A. Dunn, 147 Lynn Haven Ave., Henderson, N.C. 27536

[21] Appl. No.: 293,446

[22] Filed: Aug. 22, 1994

Related U.S. Application Data

[63] Continuation of Ser. No. 51,380, Apr. 23, 1993, abandoned.

[51] Int. Cl.[6] ..... B08B 15/02

[52] U.S. Cl. ..... 454/67; 454/64; 454/65

[58] Field of Search ..... 285/61, 151, 163, 285/165, 282, 424; 454/63, 64, 65, 67, 49

[56] References Cited

U.S. PATENT DOCUMENTS

| | | | |
|---|---|---|---|
| 1,676,969 | 7/1928 | Sutton et al. | 454/67 |
| 3,185,506 | 5/1965 | Szlashta | 285/424 X |
| 3,672,706 | 6/1972 | Chilcoat | 285/424 X |
| 3,838,732 | 10/1974 | Overmyer | 454/63 X |
| 3,999,911 | 12/1976 | Matsubara | 454/67 |
| 4,537,117 | 8/1985 | Cavestany et al. | 454/338 X |
| 4,852,470 | 8/1989 | Corrieveau | 454/338 |

FOREIGN PATENT DOCUMENTS

| | | | |
|---|---|---|---|
| 1023242 | 3/1953 | France | 454/63 |
| 11028 | 3/1905 | United Kingdom | 454/67 |
| 600439 | 4/1948 | United Kingdom | 454/64 |
| 770219 | 3/1957 | United Kingdom | 454/67 |

*Primary Examiner*—Harold Joyce
*Attorney, Agent, or Firm*—John G. Mills & Associates

[57] ABSTRACT

A hood and duct system that is lightweight, easy to install, and has at least four different adjusting points which allow exact placement for optimum operational results. The hoods are made from lightweight, clear polycarbonate so that the operator can view the equipment associated with the hood. The ducts are also made of lightweight material such as polypropylene. Also the hoods have an outwardly extending, bubble-like feature on one side so that the associated equipment can be operated without moving or removing the hood.

4 Claims, 6 Drawing Sheets

HOOD AND DUCT SYSTEM FOR TEXTILE EQUIPMENT

This is a Continuation of application Ser. No. 08/051,380 filed Apr. 23, 1993, now abandoned, by Preston A. Dunn for Hood and Duct System for Textile Equipment.

FIELD OF INVENTION

This invention relates to textile equipment and more particularly to hood and duct systems used in conjunction therewith.

BACKGROUND OF INVENTION

It is well known that large amounts of foreign material, including dust, are present in flocculate material. When a drawframe is operated to admix slivers of such flocculate material so that a single homogeneous sliver is produced for subsequent processing into twisted yarn, large amounts of dust and fibers are liberated from the sliver at each change of direction along its path of travel on the drawframe. The dust and fibers liberated into the atmosphere constitute a serious health hazard for machine operators and other persons working in the vicinity and can be linked directly to lung disorders and other respiratory problems.

Various extracting and collecting systems have been devised for removal of particulate and fibrous materials from the ambient air around operating textile equipment. These various removal means generally have included a vacuum source with various types of nozzles, pneumatic heads and the like being devised to collect the airborne materials into the system for disposal.

Even with the various prior art, dust and fiber collecting means, persons spending any appreciable time in the mill will have dust and lint on their clothes, in their hair, etc. In other words, even with the prior art dust and fiber collection systems in place and in operation, observable amounts of such dust and fibers escape into the ambient atmosphere and float throughout the open areas of the facility.

BRIEF DESCRIPTION OF INVENTION

After much research and study into the above mentioned problems, the present invention has been developed to effectively reduce the amount of dust and fibrous materials liberated into the atmosphere. This is accomplished through the use of a tapered hood positioned directly over the textile equipment, i.e. each set of rollers along table-like creels. Each hood, being larger at the bottom and tapered upward, incorporates a bubble-like feature extending outward and upward beginning at its bottom, on one side only. This bubble-like feature allows for the vertical positioning of each pivoting top roller along each creel. Also, each hood incorporates a horizontally disposed ring of a predetermined thickness attached to the periphery of the opening in the smaller end of each of said tapered hoods. This ring serves as a means of attaching each hood to the accompanying duct as set forth below.

Each of the horizontally disposed ducts has a flat bottom of such a width and thickness as to allow for the necessary boring, counter boring and routing of the same for accommodation of the aforementioned ring at the top of each hood. A damper with locking devise and an air inlet is also provided at each hood attachment location.

Extending upwardly from the flat bottom of the horizontal ducts are sides which give way to a rounded top, end to end. At each duct end is disposed a gasketed end plate matching the duct in shape and sealing the interior cavity. These end plates are held in place with removable fasteners.

Each section of horizontal duct, with hoods in placed above the table-like creels or other textile equipment, has adjustably attached ducts that extend upwardly and inwardly to join at a predetermined location. These duct extensions serve as a through means for dust and fibers being extracted and fastens directly to factory air handling systems.

DISCUSSION OF PRIOR ART

The following references represent the closest prior art of which the inventor is aware and is intended to meet the requirements of 37 CFR 1.98 for Information Disclosure Statements.

LIST OF REFERENCES

U.S. Pat. No. 1,676,969 Issue Date: Jul. 10, 1928 Inventors: Henry Moore Sutton Walter Livingston Steele Edwin Goodwin Steele U.S. Pat. No. 3,247,553 Issue Date: Apr. 26, 1966 Inventor: Jacob H. Norman U.S. Pat. No. 3,103,030 Issue Date: Sep. 10, 1963 Inventor: Robert George Sands Assignee: Carrier-Ross Engineering Company Limited London, England U.S. Pat. No. 3,999,911 Issue Date: Dec. 28, 1976 Inventor: Shigeo Matsubara Assignee: Kohkoku U.S.A., Inc. Everett, Wash.

U.S. Pat. No. 4,074,391 Issue Date: Feb. 21, 1978 Inventors: Robert B. Jenkins Jack A. Poindexter Assignee: Jenkins Metal Corporation Gastonia, N.C.

U.S. Pat. No. 4,642,852 Issue Date: Feb. 17, 1987 Inventors: Nicholas J. Turner Geoffrey A. Ogden Richard S. Bridge Assignee: National Research Development Corporation London, England U.S. Pat. No. 1,048,477 Issue Date: Dec. 31, 1912 Inventor: William E. Allington U.S. Pat. No. 3,486,309 Issue Date: Dec. 30, 1969 Inventor: James Aubrey Wild Assignee: Parks-Cramer, Ltd. Rochdale, England

CONCISE EXPLANATION OF REFERENCES

U.S. Pat. No. 1,676,969 to Sutton et al discloses a one-fan combined dust collecting and air supply system for pneumatic separators and cleaners. This patent is primarily a factory air handling system while the present invention is directed to the collection of the airborne pollutants and ties into the pre-existing factory, plant or mill air handling system. It is, of course, noted that hoods 18 are provided but this in and of itself is not novel.

U.S. Pat. No. 3,247,553 to Norman and U.S. Pat. No. 3,103,030 to Sands are both considered of interest in that they disclose manifolds with nozzles or hoods disposed adjacent pieces textile equipment but are not otherwise considered pertinent to the present invention.

U.S. Pat. No. 3,999,911 to Matsubara discloses a prior art manifold 34 with hoods 30 and 32 associated therewith. This Patent is primarily concerned with industrial vapors which are removed by the exhaust system while the particulate material is electrostatically collected for removal.

U.S. Pat. No. 4,074,391 to Jenkins, Jr. et al is specifically directed to suction currents and hoods used in conjunction with crush roll plenums for carding machines and a means for purging accumulations of foreign matter from the scraper blade.

U.S. Pat. No. 4,642,852 to Turner et al relates to dust extractors for drawframes and includes a plurality of mouth-like inlet vents 7 and even hood shaped top inlet vents 10 located at what is conceived as the sources of dust and fibrous material being liberated into the atmosphere. Other than the hood shaped top inlet vents 10, this is system is entirely different from the present invention.

Finally, U.S. Pat. No. 1,048,477 to Allington and U.S. Pat. No. 3,486,309 to Wild are both considered of general interest in that they disclose facility dust and fiber waste collecting systems but are otherwise not pertinent to the present invention.

OBJECTS OF INVENTION

In view of the above it is an object of the present invention to provide a highly efficient, lightweight, readily installable hood and duct system for textile equipment.

Another object of the present invention is to provide a readily adjustable support means for hood and duct systems used in conjunction with textile equipment.

Another object of the present invention is to provide a textile type hood and duct system that is easy to install and readily attaches to the existing air handling system of the factory, plant or mill in which it is used.

Another object of the present invention is to provide hoods used in conjunction with creel cleaning systems and the like that are constructed of high impact, clear polycarbonate so that the operator has an unrestricted view of the creel or similar equipment.

Another object of the present invention is to provide clear polycarbonate hoods for creel cleaning systems including a bubble-like extension on at least one side of each of the hoods to allow vertical positioning of the pivoting top roller without removing or relocating said hood.

Another object of the present invention is to provide in conjunction with hood and duct systems for textile equipment, ducts constructed of lightweight polypropylene.

Another object of the present invention is to provide, in a creel cleaning system, hoods that are manually removable as well as automatically retractable.

Another object of the present invention is to provide a hood and duct system for textile equipment that is easy to install and requires little or no down time.

Another object of the present invention is to provide a hood and duct system for textile equipment with multiple adjusting means so that optimum disposition of the hoods can be readily and accurately set.

Other objects and advantages of the present invention will become apparent and obvious from a study of the following description and accompanying drawings which are merely illustrative of such invention.

DETAILED DESCRIPTION OF INVENTION

Figure 1:
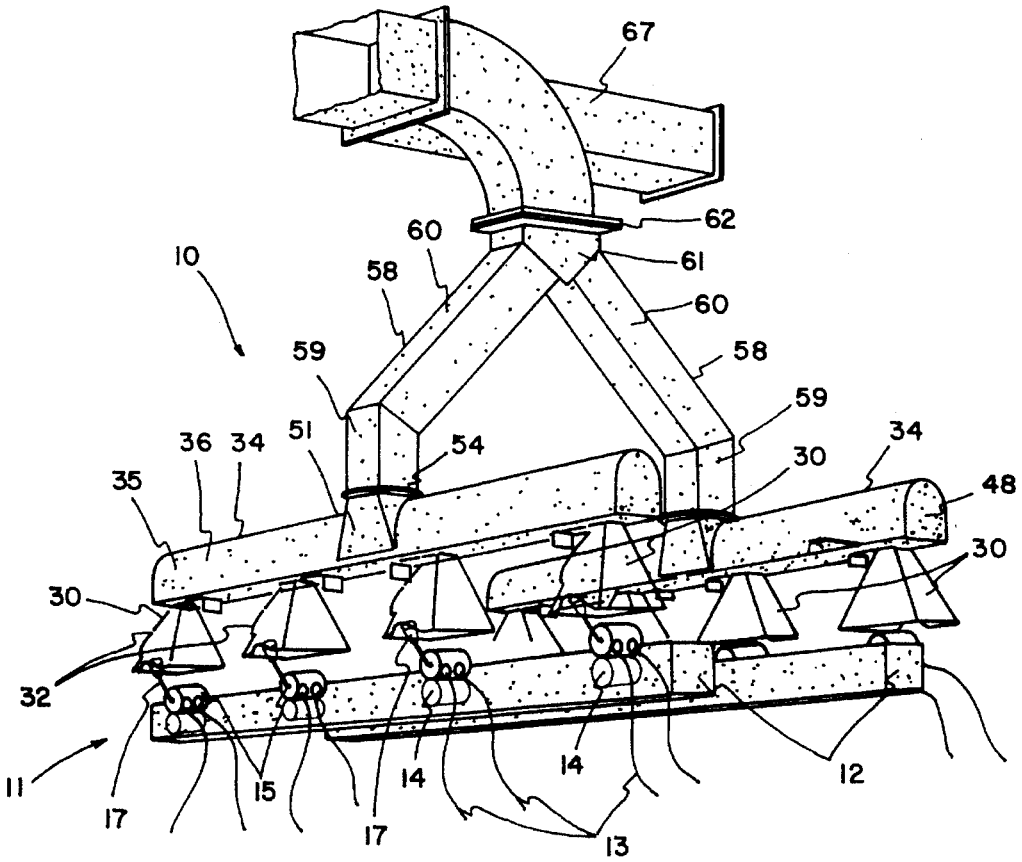
FIG. 1 is a perspective view of the hood and dust system of the present invention operatively mounted in association with a pair of drawframes.

With further reference to the drawings, the hood and duct system of the present invention, indicated generally at 10, is disposed adjacent to and above the textile equipment, indicated generally at 11, in conjunction with which such system operates.

Although the present invention can be used with other types of textile equipment, a drawframe composed of a pair of table-like creels 12 is illustrated. Drawframes admix slivers of flocculate material 13 such as cotton to form a single homogeneous sliver for subsequent processing into twisted yarn.

More specifically, multiple slivers of cotton 13 are drawn in parallel through sliver guide 13' and sets of differential drafting rollers 14 and 15 wherein the slivers are admixed and drafted to produce a suitable blended sliver which is then stored in a sliver can (not shown). Each pair of differential drafting rollers includes a non-pivoting bottom roller 14 and a pivotable top roller 15.

Figure 2:
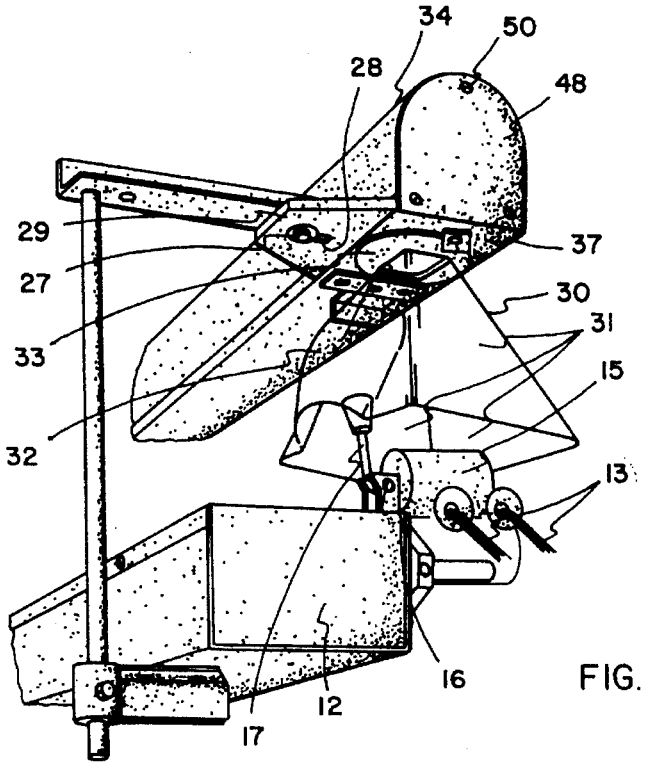
FIG. 2 is an enlarged view of the drafting rollers with the top roller in operative position adjacent the sliver guides.
Figure 3:
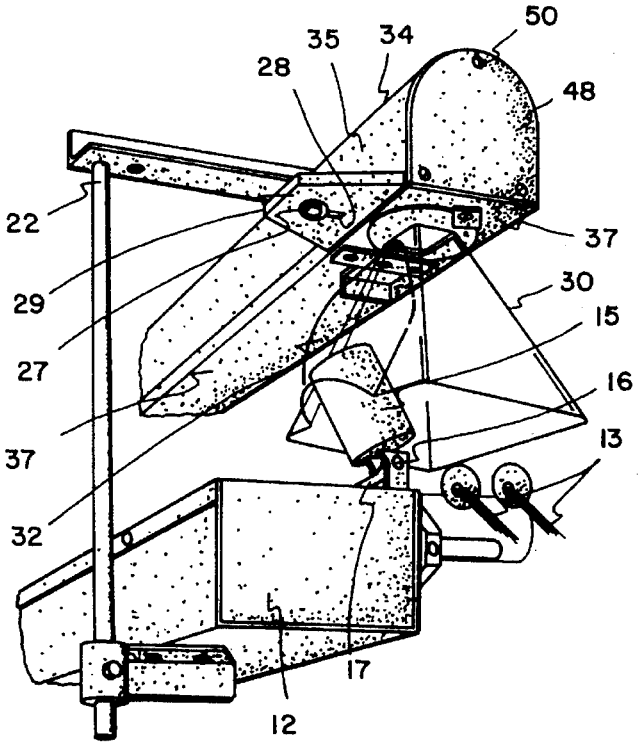
FIG. 3 is an enlarged perspective view with the top roller pivoted out of engagement with the bottom roller for maintenance and other servicing.

The top roller 15 pivots about pivot pin 16 and includes an angularly disposed handle 17 so that such top roller can be pivoted from the operating position shown in FIG. 2 to the disengaged position shown in FIG. 3 for maintenance and servicing.

A bracket 18 is provided for attachment to the textile machine in conjunction with which the hood and dust system 10 of the present invention is being used. Two openings 19 are provided in bracket 18 so that the same can be bolted or otherwise fastened to said machine.

One end of bracket 18 has a vertical sleeve 20 mounted thereon with a set screw 21 operatively associated therewith.

A support rod 22 is slidingly mounted through sleeve 20 and can be infinately adjusted up and down with set screw 21 locking the sleeve 20 to the support rod 22 when proper adjustment has been made.

Figure 9:
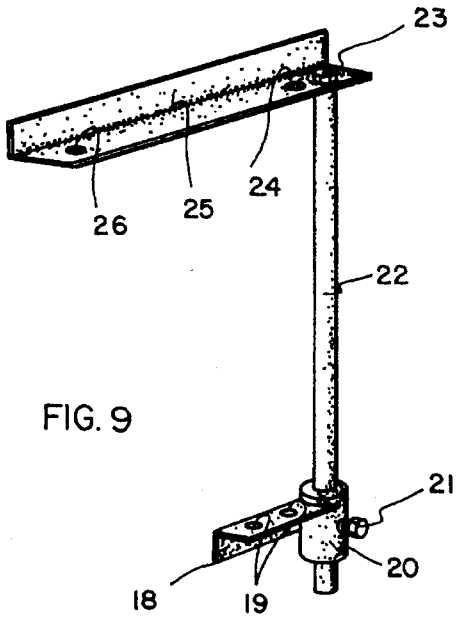
FIG. 9 is a perspective view of one of the horizontal duct supports.

The upper end of support rod 22 is tapped to receive bracket bolt 23 as clearly shown in FIG. 9. At least two openings 24 are provided in hood support bracket 25 so that side to side adjustments can be made depending on which opening is selected for bolt 23.

At the end of duct support bracket 25, opposite opening 24, is an opening 26 which is adapted to receive duct bolt 27.

Figure 4:
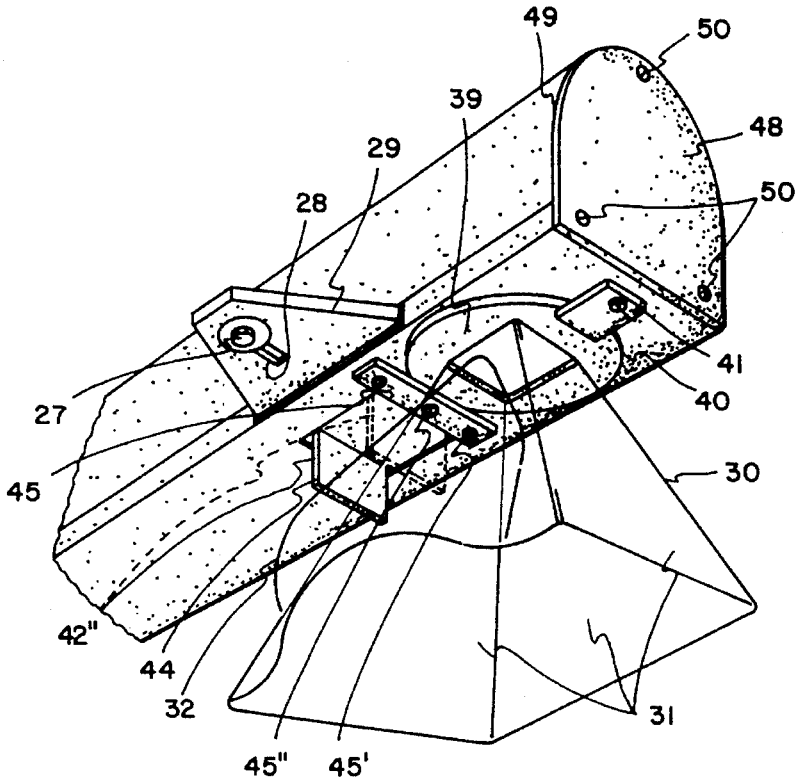
FIG. 4 is an enlarged bottom perspective view of the bottom of the horizontal duct with the hood in place.

This bolt passes through the slotted opening 28 of duct flange 29 as can clearly be seen in FIGS. 2 through 4. By loosening bolt 27, further adjustment between the duct support bracket 25 and duct flange 29 can be accomplished. Once the proper adjustment has been made, the bolt can be tightened to fix the relationship between the bracket and the flange.

A plurality of hoods 30 are preferably constructed of high impact, clear polycarbonate. This allows the operator of the machine to view the same without having to remove the hood.

Each of the hoods 30 have three generally flat, tapered sides 31 and one side with a bulbous or bubble portion 32 as can clearly be seen in FIG. 4. The upper tapered end of each of the hoods terminates in a generally circular hood flange 33. This hood flange can be integrally formed with the hood or can be secured thereto by fusing or other appropriate means.

Elongated, generally horizontally disposed ducts 34 are provided. Each of these ducts are dome shaped in cross section and include sides 35, an upper portion 36 and a bottom 37. The sides 35 are connected to the outer edges of bottom 37 by electronic plastic weldment or other suitable means.

A plurality of inlet openings 38 are provided in the bottom 37 of each of the ducts 34. A hood flange receiving seat 39 is provided about three sides of each of the inlet openings 38 as can clearly be seen in FIG. 10. This seat has a depth equal to the thickness of the circular flange 33 of hood 30. A flange retainer 40 is held in place by a screw 41. When this screw is loosened the flange can be swung to the side to allow the hood flange 33 to be placed in seat 39 and can then be pivoted back to the position shown to retain the flange in the seat.

Figure 10:
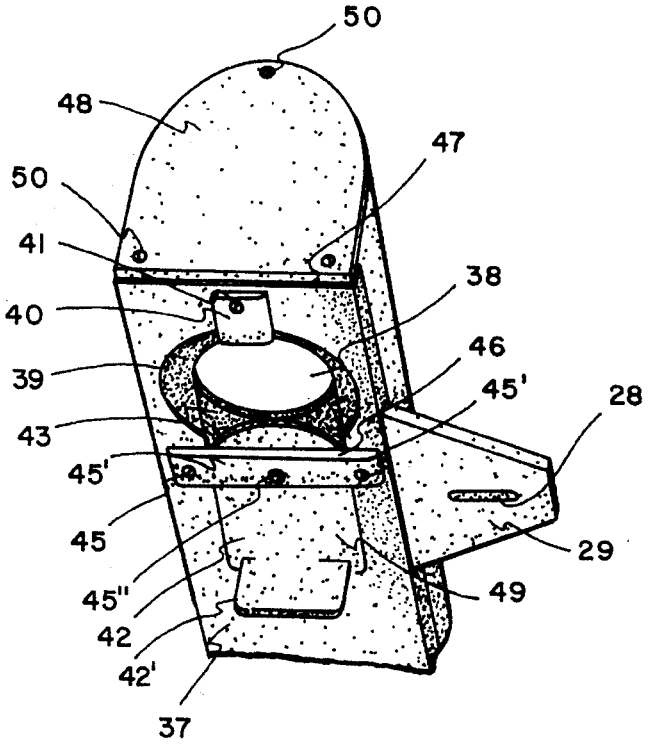
FIG. 10 is a bottom perspective view of the horizontal duct with the hood removed and the damper open.
Figure 11:
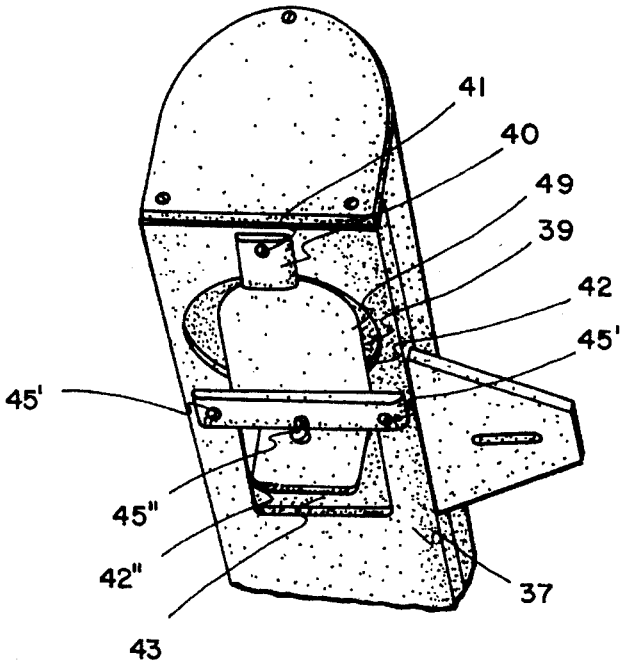
FIG. 11 is a bottom view of the horizontal duct with the damper closed.

A slide damper 32 is slidingly mounted in damper seat 43 with its outside surface 44 lying in a plane juxtapose to the plane of the bottom of flange seat 39 as can clearly be seen in FIGS. 10 and 11.

A damper and hood flange retainer 45 is provided. The edge of retainer 46 toward inlet opening 38 is straight across as can be seen in FIG. 10 so that part of the circular hood flange 33 can be placed thereunder and this, along with flange retainer 40, will hold the hood flange flush with the bottom surface 38 of duct 34.

Figure 12:
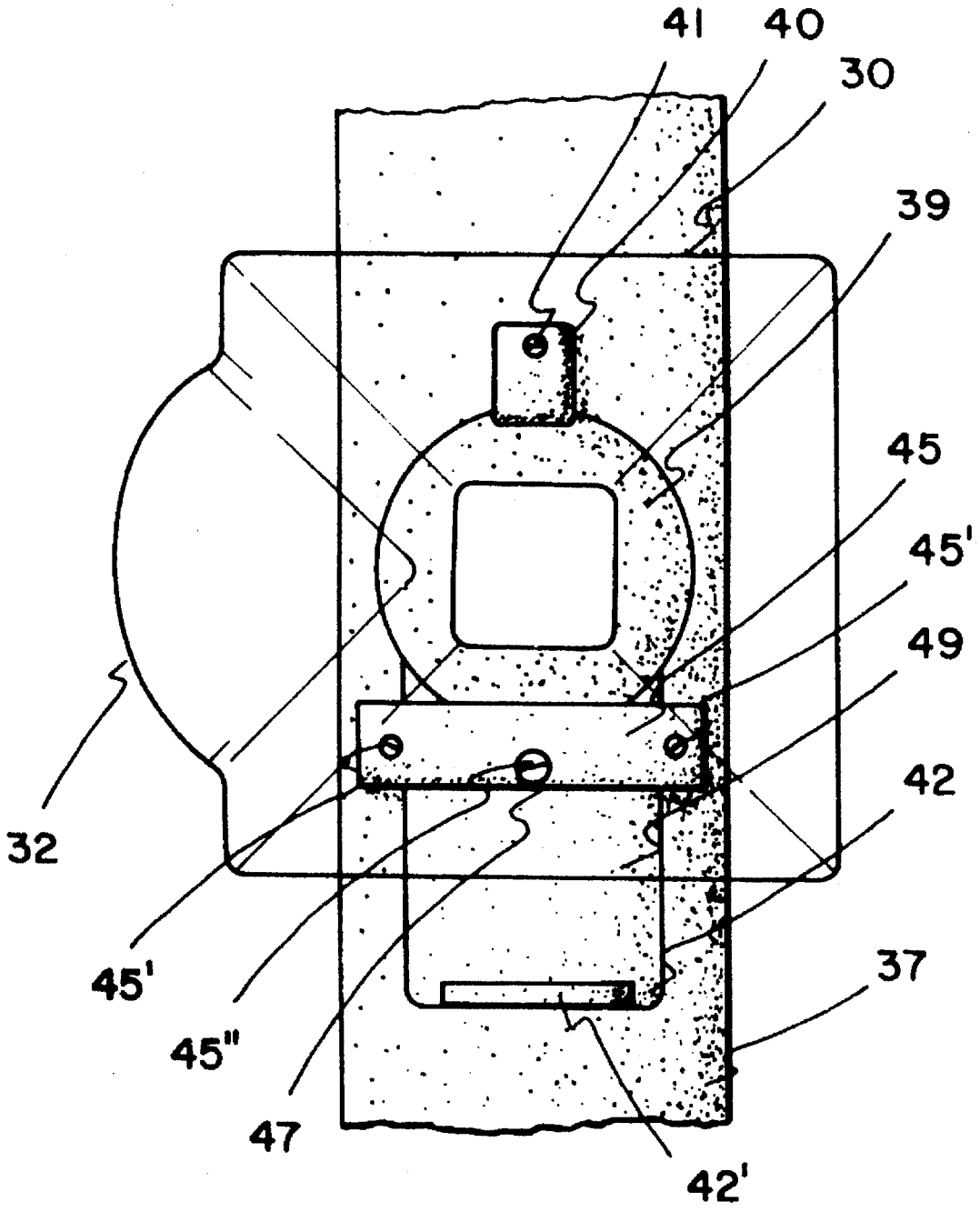
FIG. 12 is a bottom view of a horizontal duct with the hood mounted thereon and the damper open.

The edge 47 opposite edge 46 of retainer 45 projects into the slide seat 43 to hold the damper snugly therein as can clearly be seen in FIG. 12. A pair of screws or similar means 45' are provided to removingly hold retainer 45 in place once the slide damper 42 has been placed in the slide seat 43 as hereinabove described. A locking screw 45" is also provided to secure the damper from accidental movement once it has been properly adjusted.

From the above it can be seen that hood 30 can be rotated about a vertical axis for adjustment relative to the textile equipment 11 for the most advantageous positioning. The damper 42 can at the same time be opened or closed without interfering with the mounting of hood 30 through its mounting flange 33.

End caps 48 are provided for each duct 34 with a gasket 49 of closed cell neoprene or similar material being used to make an air tight seal. Three end cap screws 50 are used to hold the end cap 48 and its associated gasket 49 in place while at the same time allowing the same to be removed for cleaning or other interior maintenance on the duct 34.

A transition duct 51 is provided for each of the elongated horizontal ducts 34 with the interiors thereof being open one to the other. The transition duct can be mounted on the horizontal duct by fusion, weldment or other suitable means.

Figure 7:
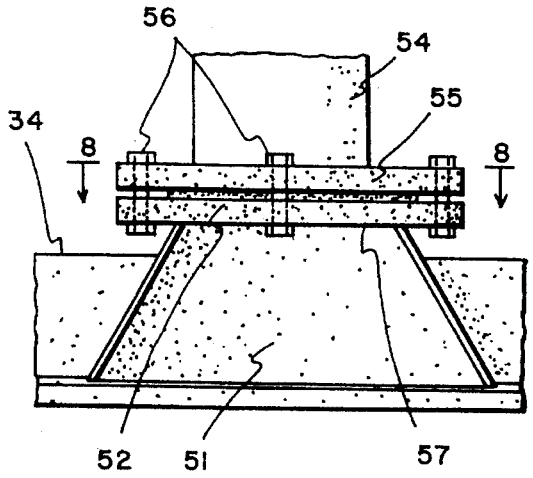
FIG. 7 is a side elevational view of the connection between the horizontal duct transition and the vertical duct.
Figure 8:
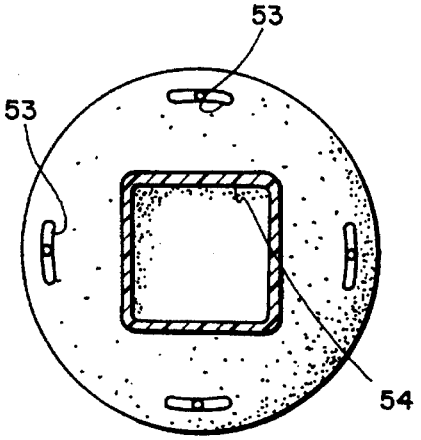
FIG. 8 is a sectional view taken through lines 8—8 of FIG. 7.

Each of the transition ducts 51 have four sides that taper inwardly and upwardly and terminate in a circular transition duct flange 52 mounted thereon as clearly shown in FIGS. 7 and 8. Four arcuate slots are provided equally spaced about the periphery of flange 52.

A relatively short vertical duct 54 has a generally circular flange 55 secured to the lower end thereof. This flange also has arcuate slots 53 in its periphery that correspond to the arcuate slots in flange 52. A plurality of bolts 56 are adapted to pass through the slots 53. A gasket 56 formed from closed cell neoprene or similar material is placed between the flanges and the bolts are tightened to form an airtight seal between the transition duct and the vertical duct.

A club shaped duct 58 with a 45° bend in the lower portion thereof telescopically mounts over vertical duct 54 and adequate gasket means (not shown) are used to make this connection air tight. This telescopic joint allows additional adjustments to be made in the positioning of the elongated duct 34 carrying hoods 30 over the textile equipment 11.

If it is determined that the telescopic adjustment between vertical duct 54 and the short leg 59 of club shaped duct 58 is not needed, then the lower portion of such short leg duct can terminate in flange 55 which is secured to flange 52 of transition duct 51.

For each pair of horizontal ducts 34, the long leg 60 of the associated club shaped duct will be disposed toward the other club shaped duct so that the two can terminate at their upper ends in connector duct 61. The interior of the upper portion of each of the club shaped ducts 58 are open to the interior of connector duct 61.

About the periphery of the upper edge of connector duct 61 is an outwardly projecting flange 62. Bolt holes 63 are provided in this flange and they align with elongated recesses 65 in the outer edges of adapter plate 64.

Figure 6:
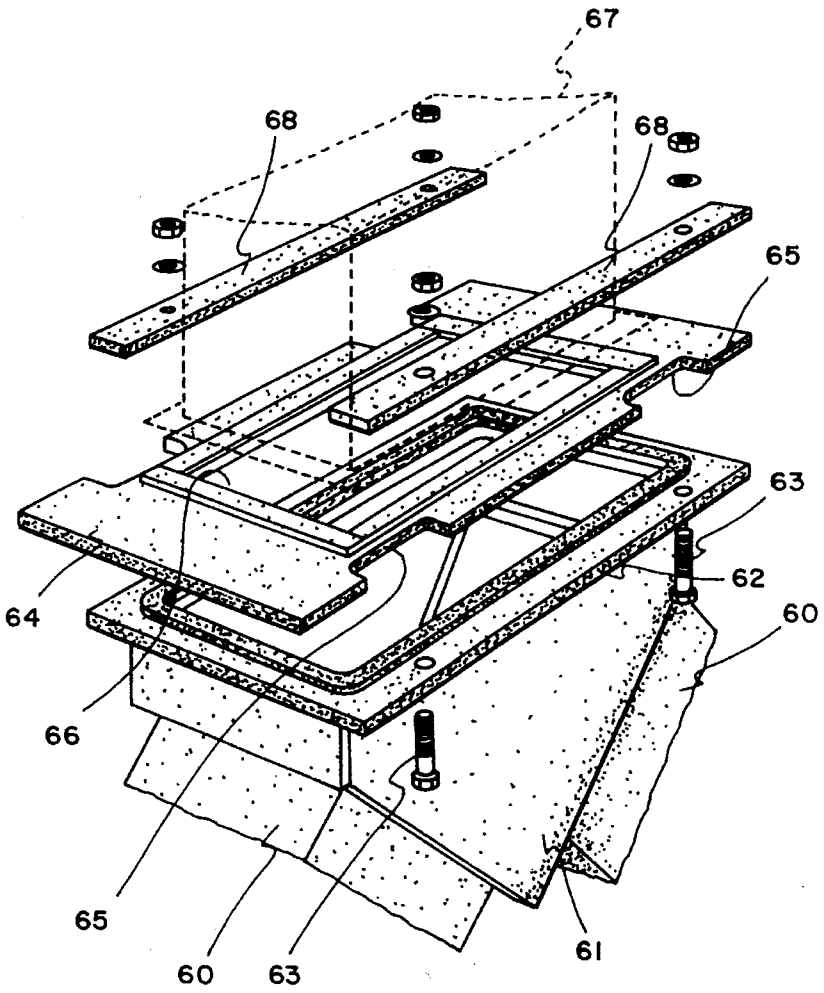
FIG. 6 is an exploded view of the connector of FIG. 5.

The interior opening 66 in adapter plate 64 is so sized to receive the flanged end of a duct connected to the air handling system 67 of the mill, plant or factory where the hood and duct system of the present invention is used. Hold-down clamps 58 are provided on the upper surface of adapter plate 64 as can clearly be seen in FIGS. 5 and 6.

Figure 5:
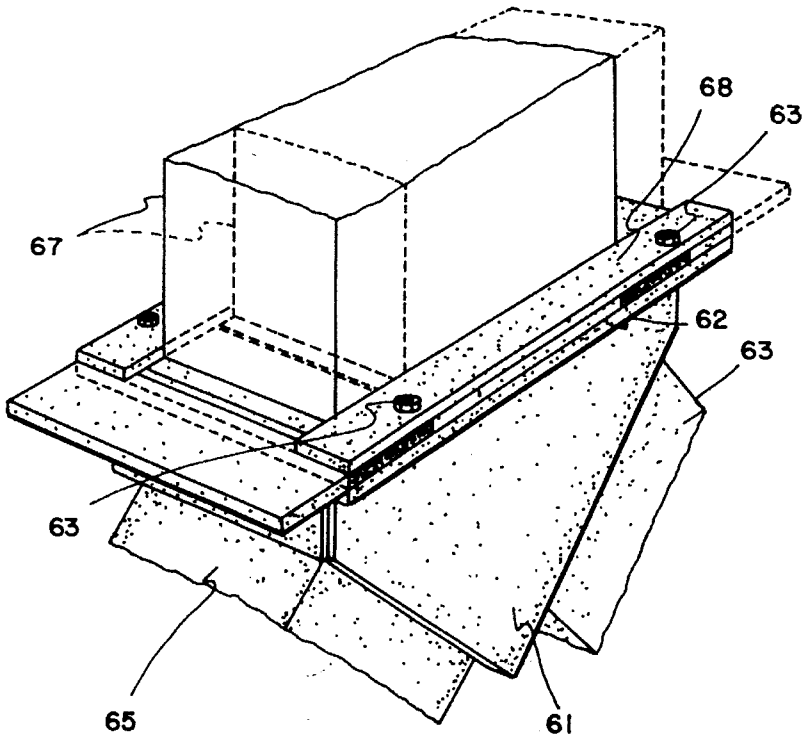
FIG. 5 is a perspective view of the adjustable connector between the duct system and the factory air handling system.

When bolts 63 are loosened to loosen clamps 68, the adapter plate 64 and its associated duct 67 can be moved or adjusted from the position shown in solid lines to the position shown in dotted lines in FIG. 5 thus allowing additional position adjustments to be made in the overall hood and duct system.

In view of the fact that air handling systems and their associated duct work may vary from factory to factory and may include rectangular, square and round-in-cross-section configurations, some additional sizing and configuration adapters may be required. Since duct work of this type is well known to those skilled in the art, further detailed discussion of the same is not deemed necessary.

Since the hoods 30 readily disconnect from the elongated ducts 34, and further since the club shaped ducts 58 can readily be shipped separate from the connector duct 61 and the transition duct 51, the present invention can be easily fabricated and readily transported to the installation site in compact packages. Further, since the entire system except for gaskets, bolts and screws, is constructed from lightweight polypropylene and clear, high impact polycarbonate, shipping, handling and support during use are all accomplished with minimum equipment and labor.

When the system of the present invention has been fabricated, moved to the location where it is to be used, and is assembled including connection to the air handling system 67 of the factory, adjustments can be made for maximum operational efficiency by manipulating the connection between the air handling system 67 and the connector ducts 61; between the club shaped duct 58 and the vertical duct 54; between the vertical duct 54 and the transition duct 51; and finally the orientation of the hood 30 and its associated bubble portion 32 by turning the same about its vertical axis.

From the above it can be seen that the present invention has the advantage of providing a relatively inexpensive and yet highly efficient means for removing airborne dust and fibrous material from the ambient air around operating textile equipment.

The terms "top", "bottom", " vertical", "horizontal" and so forth have been used herein merely for convenience to describe the present invention and its parts as oriented in the drawing. It is to be understood, however, that these terms were in no way limiting the invention since such invention may obviously be disposed in different orientations when in use.

The present invention may, or course, be carried out in other specific ways than those herein set forth without departing from the spirit and essential characteristics of such invention. The present embodiments are, therefore, to be considered in all respects illustrative and not restrictive, and all changes coming within the meaning and equivalence range of the appended claims are intended to be embraced therein.

What is claimed is:

1. A hood and duct system comprising: a generally horizontally disposed first duct means; at least one hood means rotatively adjustably connected to said first duct means for disposition adjacent textile equipment creating airborne pollution, said at least one hood means includes at least one bubble-like, outwardly projecting extension whereby equipment under the hood can be manipulated without adjusting or removing said hood; a horizontally and vertically adjustable support means connected between said generally horizontally disposed first duct means and said textile equipment; a transition second duct means fixedly mounted on said first duct means; a generally vertically disposed third duct means rotatively adjustably connected to said second duct means; an angularly disposed, telescopically adjustable fourth duct means connected to said third duct means; connector fifth duct means connected to said fourth duct means; and means for slidably adjustably connecting said fifth duct means to a pre-existing vacuum source whereby through the manipulation of the various adjustably connections between the various ducts, the hood means can be placed at the most advantageous position adjacent the textile equipment for optimum performance.

2. The hood and duct system of claim 1 wherein said textile equipment is a drawframe.

3. The hood and duct system of claim 1 wherein said ducts are constructed from lightweight polypropylene.

4. The hood and duct system of claim 1 wherein said at least one hood means is constructed from high impact, clear polycarbonate.

* * * * *